US006269675B1

(12) United States Patent
Burnett

(10) Patent No.: US 6,269,675 B1
(45) Date of Patent: Aug. 7, 2001

(54) CRIMPING TOOL FOR PLASTIC PIPE AND THE LIKE

(75) Inventor: Robert C. Burnett, Erie, PA (US)

(73) Assignee: Reed Manufacturing Co., Erie, PA (US)

( * ) Notice: Subject to any disclaimer, the term of this patent is extended or adjusted under 35 U.S.C. 154(b) by 0 days.

(21) Appl. No.: 09/349,330

(22) Filed: Jul. 8, 1999

(51) Int. Cl.[7] ..... B21D 9/08; B21J 9/18

(52) U.S. Cl. ..... 72/454; 72/407; 72/409.19; 72/454; 29/237

(58) Field of Search ..... 72/454, 407, 409.01, 72/409.19; 29/243.57, 237

(56) References Cited

U.S. PATENT DOCUMENTS 2,359,696 * 10/1944 Turtle ..... 72/409.19
2,903,929 * 9/1959 McVey ..... 72/454
3,469,434 * 9/1969 Davis ..... 59/454
4,445,358 * 5/1984 Gooding ..... 72/416
5,140,736 * 8/1992 Hsiao ..... 59/7

FOREIGN PATENT DOCUMENTS

1280796 * 10/1968 (DE) ..... 72/454

* cited by examiner

*Primary Examiner*—David Jones
(74) *Attorney, Agent, or Firm*—Richard K. Thomas

(57) ABSTRACT

A first jaw is rigidly mounted to a handle. A second jaw is pivotally mounted to a portion of the first jaw adjacent the portion to which the handle is secured. A spring biases second jaw member toward a closed position with respect to the first jaw. A crimping force application assembly is rotatably attached to the second jaw using a bushing which rotatably receives a second end of a longitudinally extending rod of the assembly. A second end of the rod is threadedly received in a spindle. The spindle has first and second pintles which can be seated in slots in the upper surface of the first jaw. The rod can be rotated using a manually actuated member or a second member which can be engaged by a power tool or hand tool to draw the first jaw engaged by the spindle toward the second jaw which is attached to the bushing applying a crimping force to a compression sleeve to affix it to a portion of plastic pipe.

11 Claims, 2 Drawing Sheets

CRIMPING TOOL FOR PLASTIC PIPE AND THE LIKE

BACKGROUND AND SUMMARY OF THE INVENTION

The present invention is directed to a crimping tool which can be used to attach compression sleeves on plastic pipes. More particularly, the present invention is directed to a crimping tool which can be actuated manually or by a power or hand tool.

Available crimping tools include U.S. Pat. Nos. D303, 917; 3,958,442; 4,221,048; 4,337,635; 4,342,216; 4,480, 460; 4,508,888; 4,604,890; 4,796,461; 5,012,666; 5,094, 097; 5,280,716; 5,596,800; 5,611,236; and 5,743,131. These prior art devices have any number of draw backs. Some require two handed operation; others require repeated gripping and release as the ratchet mechanism operates the crimping device. Still other devices are bulky and difficult to operate. Finally, some employ hydraulics or have other construction features which make them costly.

The present invention is a manually operable crimping tool comprising a first jaw member for engaging an element to be crimped; a handle fixedly attached to said first jaw member; a second jaw member for engaging the element to be crimped, said second jaw member being pivotally attached to said first jaw member, a crimping-force-application assembly including i) means to pivotally attach said assembly to one of said first and second jaw members; ii) means to releasably engage another one of said first and second jaw members, said means to releasably engage being movable between a first open position permitting movement of said first and second jaw members onto and off of the element to be crimped and a second engaged position permitting application of a crimping force; iii) manually operable means to reduce a distance between said means to pivotally attach said assembly and said means to releasably engage thereby causing said first and second jaw members to interact to crimp the element therebetween. The second pivotal jaw is preferably spring biased toward the first jaw. A secondary means to reduce the distance is provided to enable a power tool to be used to provide the crimping force.

Elements to be crimped onto the plastic pipe include various fixtures as well as couplers used in connecting adjoining sections of pipe. These elements are typically made of brass, copper, or zinc coated copper but it will be understood the crimper of the present design can be employed to crimp elements made of other materials. It will be understood that the term "plastic pipe and the like" includes conventional pex (cross-linked polyethylene) pipe as well as other plastics, thin walled metallic pipe, and a pipe popular in Europe which sandwiches a thin walled metallic pipe between two thicknesses of plastic pipe.

Various other features, advantages and characteristics of the present invention will become apparent to one of ordinary skill in the art after a reading of the following specification.

BRIEF DESCRIPTION OF THE DRAWINGS

The features of the present invention are discussed in conjunction with the figures, like items bearing like reference numerals, and in which.

DETAILED DESCRIPTION OF PREFERRED EMBODIMENT(S)

Figure 1:
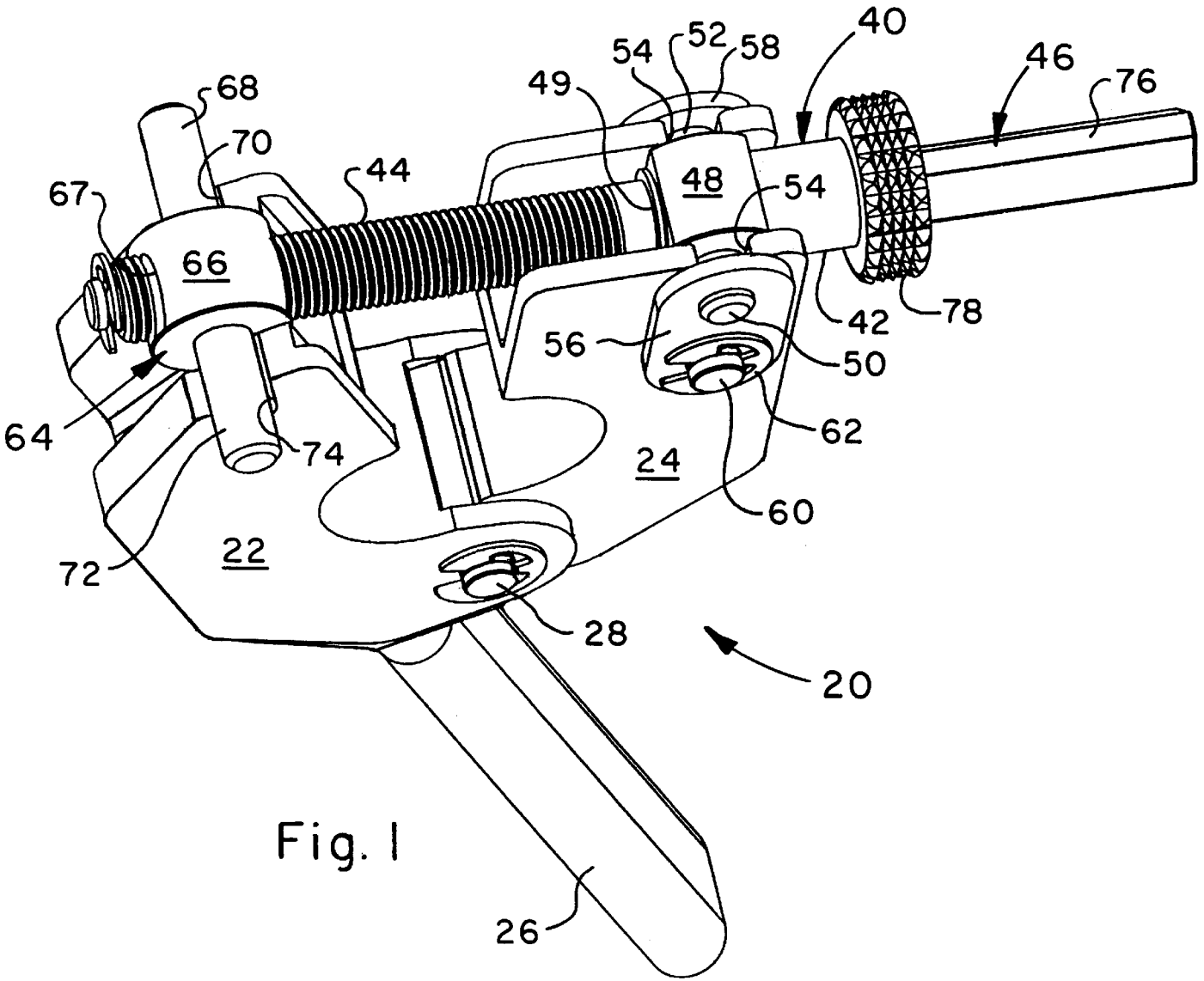
FIG. 1 is a perspective view of a first embodiment of the crimping tool of the present invention.
Figure 2:
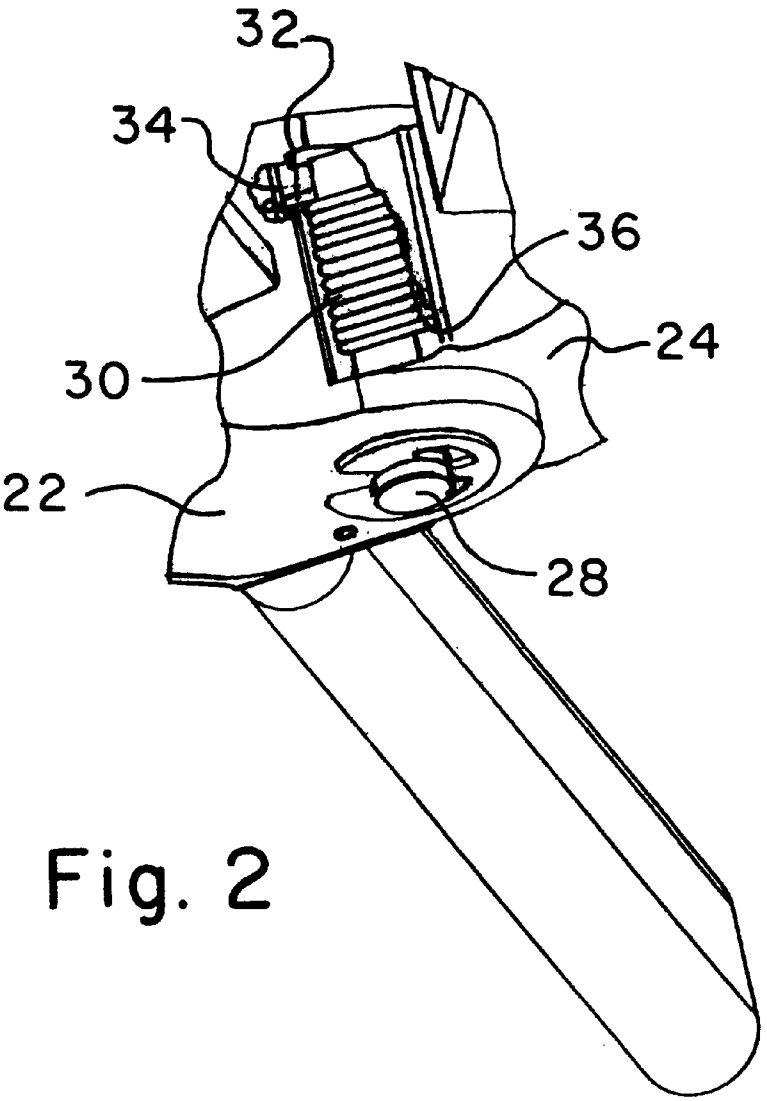
FIG. 2 is a partial perspective view with portions broken away to depict internal details.

The first preferred embodiment of the crimping tool of the present invention is depicted in FIG. 1 generally at 20. Crimping tool 20 includes first jaw 22 fixedly attached to handle 26. A second jaw 24 is pivotally attached to first jaw 22 by pivot shaft 28. Spring 30 (FIG. 2) encircles shaft 28 and has a first arm 32 which reacts against pin 34 and a second arm 36 which reacts against second jaw 24 to bias it to a closed position to make its placement and operation easier. A crimping force application assembly 40 is pivotally mounted to second jaw 24. Although the internal faces of jaws 22 and 24 are shown as being smooth, it will be appreciated that these faces may be equipped with a plurality of circumferentially extending ridges (three, by way of example) to provide a pattern of indentations in the metal fitting, as is customary in the industry. Crimping force application assembly 40 comprises an elongated rod 42 having a first threaded end 44 and a second unthreaded end 46 which is rotatably received in a through bore 49 in bushing 48. Bushing 48 has a longitudinal pivot axis defined by first end 50 and second end 52 which are seated in slots 54 in second jaw 24. First pivot plate 56 rotatably receives first end 50 and second pivot plate 58 rotatably receives second end 52 and keeps ends 50 and 52 seated in slots 54. Pin 60 secures plates 56 and 58 to second jaw 24 using a pair of circlips 62 (one shown).

A spindle 64 has a central portion 66 with a lateral, internally threaded throughbore 67 for threadably engaging the first end 44 of said elongated rod 42. Spindle 64 has first pintle 68 extending from said central portion which is releasably received in slot 70 of first jaw 22 and a second pintle 72 extending from an opposite side of said central portion 66 releasably received in slot 74. Second end 46 of elongated rod 42 is equipped with a first manually operable means to reduce the distance between bushing 48 and spindle 64 in the form of knurled cylindrical element 78 and a secondary means in the form of a polygonal shaft (preferably hexagonal) 76 which can be engaged by a power tool such as a drill (not shown).

In use, second jaw 24 will be pivoted open against the force of spring 30 and assembly 40 will be pivoted upwardly about first (50) and second (52) ends of bushing 48 and jaws 22 and 24 permitted to encircle a compression sleeve (not shown) or other element to be secured to a length of plastic pipe. The inner circumference of jaws 22 and 24 is slightly less than the circumference of the compression sleeve in its uninstalled condition. Spring 30 is permitted to pivot jaws 22 and 24 together and crimping force application assembly 40 is lowered across the top of jaws 22 and 24. Pintles 68 and 72 of spindle 64 are inserted in slots 70 and 74, respectively. Rod 42 is rotated about its longitudinal axis either manually using knurled element 74 or by engaging a power tool or hand tool (power/hand tool) with polygonal shaft 76 causing spindle 64 to be drawn toward bushing 48 applying a crimping force to the element to be attached securing it to the plastic pipe.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A manually operable crimping tool comprising a) a first jaw member for engaging an element to be crimped;

b) a handle fixedly attached to said first jaw member;

c) a second jaw member for engaging the element to be crimped, said second jaw member being pivotally attached to said first jaw member for pivotal movement about a first axis;

d) a crimping-force-application assembly including i) means to pivotally attach said assembly to one of said first and second jaw members for pivotal movement about a second axis generally parallel to said first axis;

ii) means to releasably engage another one of said first and second jaw members, said means to releasably engage being movable between a first disengaged position in which said crimping-force-application assembly is not touching said second jaw member permitting movement of said first and second jaw members onto and off of the element to be crimped and a second engaged position permitting application of a crimping force;

iii) manually operable means to reduce a distance between said means to pivotally attach said assembly and said means to releasably engage thereby causing said first and second jaw members to interact to crimp the element therebetween.

2. The crimping tool of claim 1 wherein said second jaw member is pivotally attached to a portion of said first jaw member adjacent a point at which said handle is fixedly attached to said first jaw.

3. The crimping tool of claim 2 wherein said second jaw is spring biased toward said first jaw member.

4. The crimping tool of claim 1 wherein said crimping-force-application assembly further comprises an elongated rod having a first end and a second end.

5. The crimping tool of claim 4 wherein said means to pivotally attach comprises a) a bushing with a longitudinal pivot axis, said bushing having first and second ends, said bushing having a transverse throughbore that receives said elongated rod;

b) first and second pivot plates engaging said first and second ends of said bushing respectively to permit rotation about said longitudinal pivot axis, said first and second pivot plates secured to opposite sides of said one jaw member.

6. The crimping tool of claim 5 wherein said manually operable means comprises a knurled cylindrical element fixed to said elongated rod adjacent said first end thereof outboard of a point at which said elongated rod extends through said bushing.

7. The crimping tool of claim 6 further comprising secondary means for reducing said distance which is engageable by a power/hand tool.

8. The crimping tool of claim 4 wherein said first end of said rod is threaded.

9. The crimping tool of claim 8 wherein said means for releasably engaging comprises a spindle with a lateral, internally threaded throughbore for threadably engaging said first end of said elongated rod.

10. The crimping tool of claim 9 wherein said spindle further comprises first and second pintles extending from a central portion of said spindle which contains said throughbore, said pintles being releasably received in slots in opposing sides of said other jaw member.

11. A manually operable crimping tool which includes means to permit operation by a power/hand tool, said crimping tool comprising a) a first jaw member for engaging an element to be crimped;

b) a handle fixedly attached to said first jaw member;

c) a second jaw member for engaging the element to be crimped, said second jaw member being pivotally attached to said first jaw member;

d) a crimping-force-application assembly including i) means to pivotally attach said assembly to one of said first and second jaw members;

ii) means to releasably engage another one of said first and second jaw members, said means to releasably engage being movable between a first open position permitting movement of said first and second jaw members onto and off of the element to be crimped and a second engaged position permitting application of a crimping force;

iii) manually operable means to reduce a distance between said means to pivotally attach said assembly and said means to releasably engage thereby causing said first and second jaw members to interact to crimp the element therebetween;

e) secondary means for reducing said distance, said secondary means being operable by a power/hand tool.

* * * * *